US005551676A

United States Patent [19]

Tibbet

[11] Patent Number: 5,551,676

[45] Date of Patent: Sep. 3, 1996

[54] DUAL CLAMPING VISE

[75] Inventor: Michael D. Tibbet, Ventura, Calif.

[73] Assignee: Gaiser Tool Co., Ventura, Calif.

[21] Appl. No.: 409,700

[22] Filed: Mar. 24, 1995

[51] Int. Cl.[6] ..... B25B 1/20

[52] U.S. Cl. ..... 269/43; 269/154; 269/244; 269/283

[58] Field of Search ..... 269/43, 45, 152–155, 269/244, 906, 279, 283

[56] References Cited

U.S. PATENT DOCUMENTS

| | | | |
|---|---|---|---|
| 468,272 | 2/1892 | Watt . | |
| 1,009,410 | 11/1911 | Hawkins . | |
| 1,453,018 | 4/1923 | McHewitt et al. | 269/152 |
| 2,117,725 | 5/1938 | Johnson . | |
| 3,168,893 | 2/1965 | Johnson . | |
| 3,854,712 | 12/1974 | McGee | 269/152 |
| 4,437,654 | 3/1984 | Chiappetti . | |
| 4,607,829 | 8/1986 | Suska | 269/152 |
| 4,706,949 | 11/1987 | Dossey . | |
| 4,824,085 | 4/1989 | Buchler . | |
| 4,861,011 | 8/1989 | Varga . | |
| 4,898,371 | 2/1990 | Mills . | |
| 4,934,674 | 6/1990 | Bernstein | 269/154 |
| 5,019,129 | 5/1991 | Johanson . | |
| 5,094,436 | 3/1992 | Stephan | 269/154 |

OTHER PUBLICATIONS

EROWA ManoSet, Clamps more, costs less, 1036 e/4000/3 92 (1992).

Mecatool ICS Elemente–Ubersicht, A 000004 D/E/F/I/J/R 3.92 (1992).

Concept WEDMing System 3R, T–1143–E 93.10 (1993).

*Primary Examiner*—Robert C. Watson

*Attorney, Agent, or Firm*—Kenneth J. Hovet

[57] ABSTRACT

A unitary vise body is provided having a flat upper reference surface extending between opposing first and second ends. A first stationary jaw extends upwardly from the reference surface at the first end of the vise. A second stationary jaw extends upwardly from the reference surface at a location about half-way between the first and second ends. Both the first and second stationary jaws have workpiece abutment surfaces that extend from the reference surface at an angle that corresponds to the reference surface angle of a workpiece clamping extension. The area between the first and second stationary jaws defines a first clamping region and includes a movable jaw which is actuated by a threaded shaft that extends through a threaded opening in the lower portion of the jaw. The area of the vise extending from the second stationary jaw to the opposing end of the vise defines a second clamping region. This region includes a second movable jaw that is actuated by a threaded shaft in the same manner as the first movable jaw. To accommodate different-sized workpieces and different clamping extensions, adaptors are used which precisely interfit within each clamping region. The adaptors include corresponding abutment faces and upper surfaces that function as reference surfaces.

18 Claims, 4 Drawing Sheets

DUAL CLAMPING VISE

BACKGROUND OF THE INVENTION

1. Field of the Invention

The invention pertains to clamping apparatus and, more particularly, to a vise for holding two workpieces within the operating area of a machining apparatus.

2. Description of Related Art

The present invention has particular utility as a substitute for the workpiece clamp disclosed in Applicant's application Ser. No. 08/288,067, filed Aug. 10, 1994, now U.S. Pat. No. 5,487,538. This application describes a multi-component assembly for adjustably positioning a workpiece at a precise location relative to a machine tool.

The invention has special advantages in relation to the screw machine and lathe turning industry. In this industry it is known that cutting tool bits become worn and dull after a relatively short period of use. To minimize downtime, it is therefore important to have a second tool bit available to replace the dull one. A problem arises, however, when the second tool bit was not produced with a reference surface and related coordinates that were identical to the first tool bit. Consequently, the machine operator must go through the time-consuming steps of precisely realigning and truing the replacement tool bit so that it will perform exactly as the original tool bit.

SUMMARY OF THE INVENTION

The present invention overcomes the above problem by enabling the production of two identical parts with one vise which also have been referenced in an identical manner. This is accomplished with a vise that includes two clamping regions having identically aligned and referenced engagement surfaces. The engagement surfaces correspond to the same surfaces which will be engaged by a machining apparatus. Therefore, two tool bits, or similar items, can be produced which have been referenced in an identical manner. As such, the tool bits are entirely interchangeable, changeover time is reduced to an absolute minimum and more accurate parts are produced.

DESCRIPTION OF THE PREFERRED EMBODIMENTS

Figure 1:
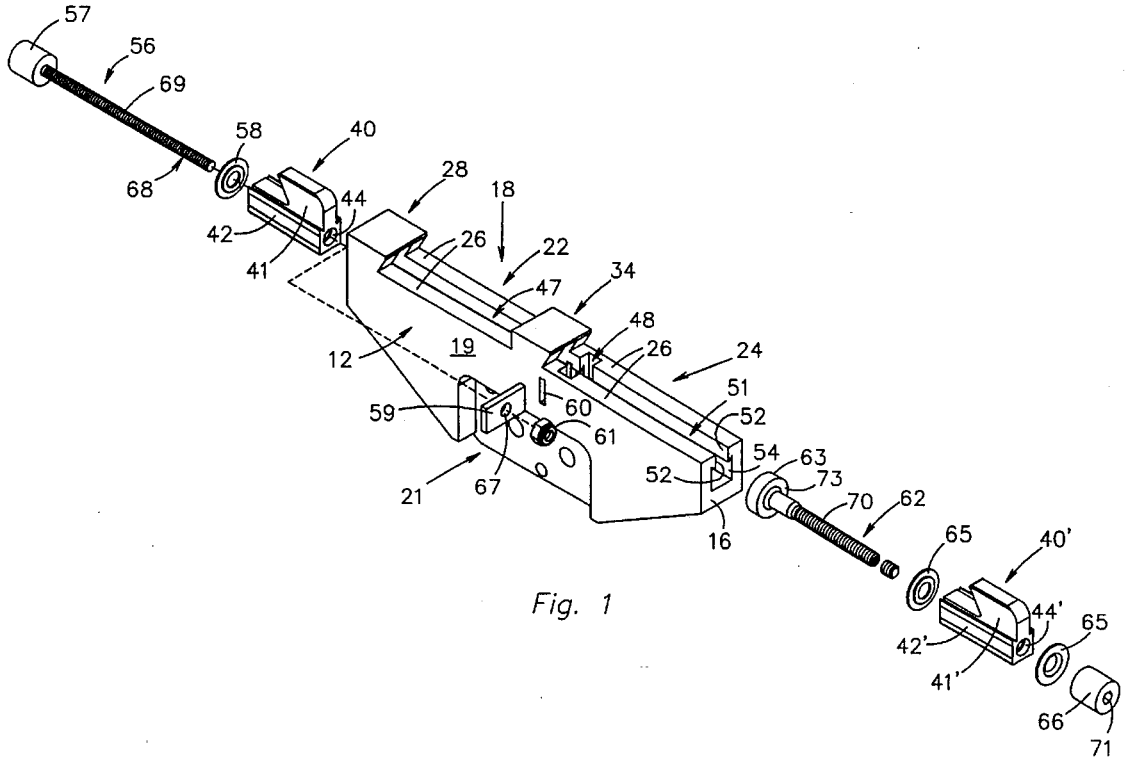
FIG. 1 is an exploded front isometric view of the single body dual clamping vise of the present invention.
Figure 14:
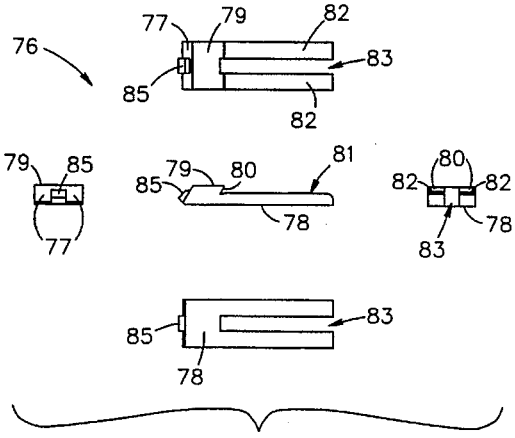
FIG. 14 comprises combined multiple orthogonal views of an adaptor shown in FIG. 10.
Figure 10:
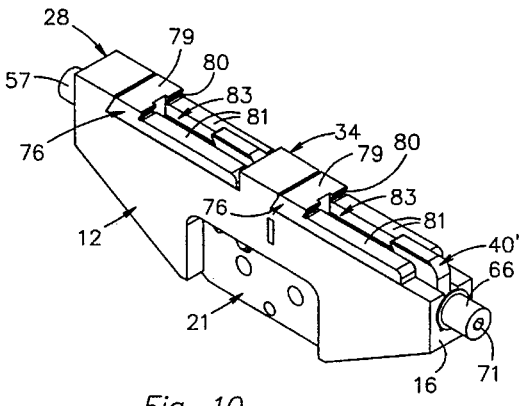
FIG. 10 is a front isometric view of the vise shown in FIG. 2, including adaptors positioned within first and second clamping regions.
Figure 7:
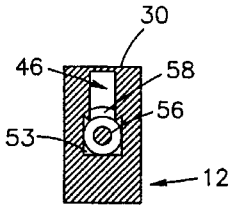
FIG. 7 is a cross-sectional view taken along lines 7—7 of FIG. 2.

With particular reference to FIGS. 1 through 9 of the drawings, the basic assembly of the invention is shown generally by reference 10. The main supporting element of the invention comprises vise body 12. Preferably the vise body comprises a solid metal plate with an outline similar to an inverted truncated trapezoid that is bilaterally symmetrical about its median vertical axis. It has wide flat peripheral end surfaces that are square with the front face 19 and back face 20. The lower area of the front face is recessed and extends coextensively from bottom end 13 upwardly about half the vertical extent of the vise body. This area comprises a connector portion 21 and includes multiple adjustment and fastener openings 23.

The connector portion is used to attach the vise body to a workpiece alignment part. In applicant's application Ser. No. 08/288,067, now U.S. Pat. No. 5,487,538, this part is designated as a leveler head and provides multiple adjustment means for precisely aligning the workpiece in a machining apparatus. It will be appreciated that the vise may have other polygonal, oval or round outlines as dictated by specific applications.

Figure 2:
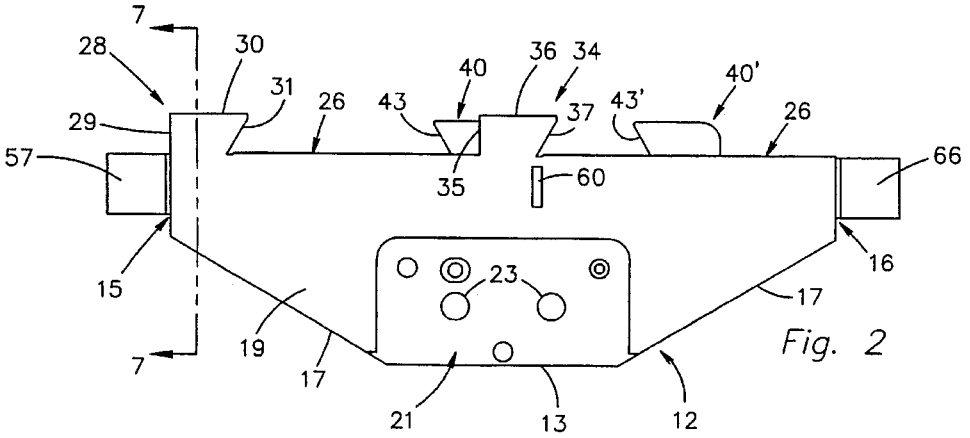
FIG. 2 is a top plan view of the assembled vise of FIG. 1.
Figure 3:
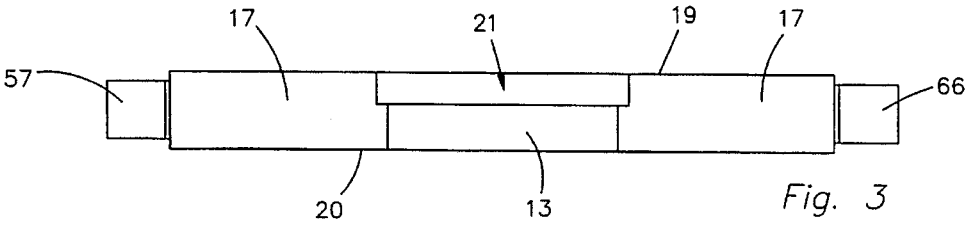
FIG. 3 is a bottom end view of the vise shown in FIG. 2.
Figure 4:
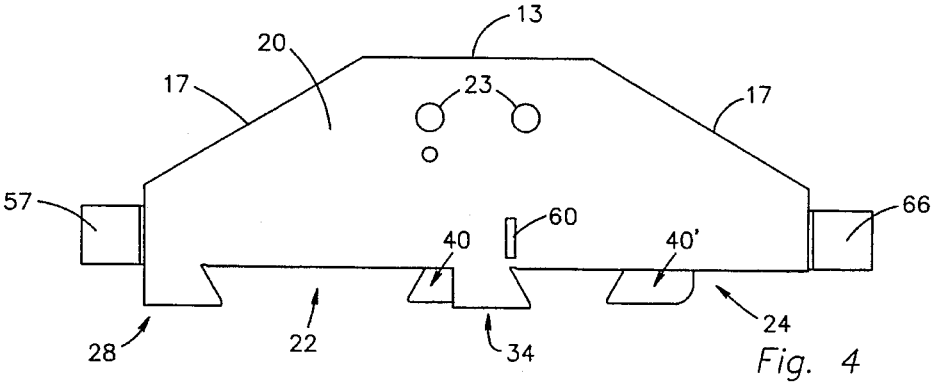
FIG. 4 is a back side plan view of the vise shown in FIG. 2.
Figure 13:
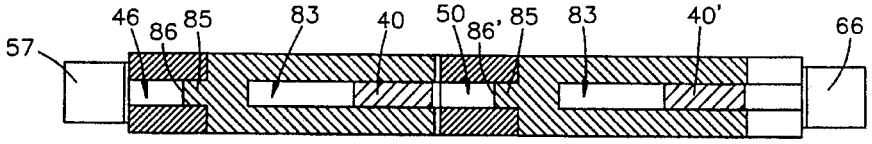
FIG. 13 is a cross-sectional view taken along lines 13—13 of FIG. 11.
Figure 12:
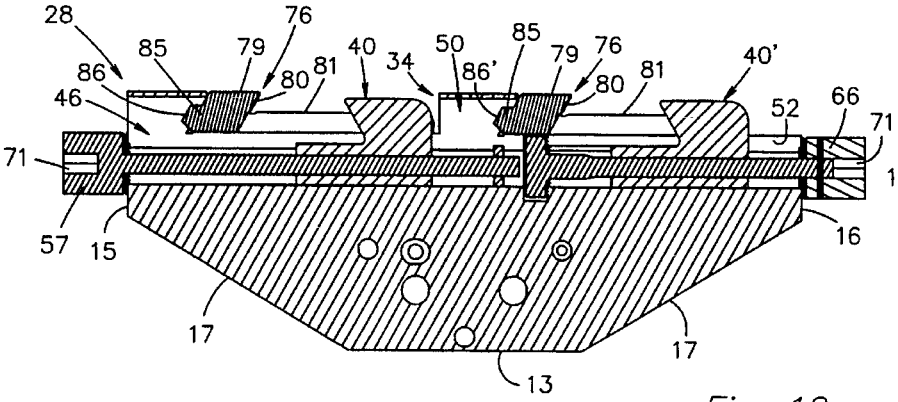
FIG. 12 is a cross-sectional view taken along lines 12—12 of FIG. 11.
Figure 11:
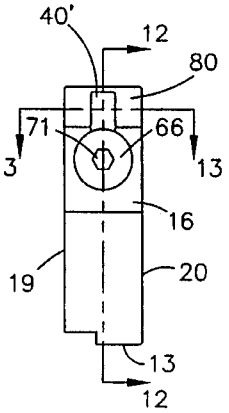
FIG. 11 is a right end elevation view of the vise shown in FIG. 10.
Figure 9:
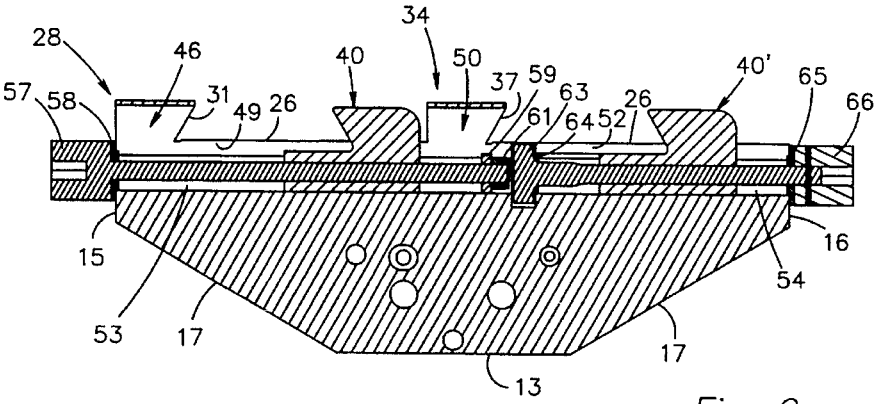
FIG. 9 is a cross-sectional view taken along lines 9—9 of FIG. 2.
Figure 6:
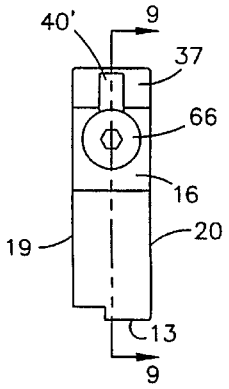
FIG. 6 is a right end elevation view of FIG. 2.

As best shown in FIG. 2, the vise body periphery is defined by the aforementioned bottom end 13 from which extend opposing inclined sides 17. The sides merge into respective first end 15 and second end 16. The distance between the first and second ends defines the longitudinal extent of the overall vise clamping portion 18.

The upper area of first end 15 forms the backside 29 of first stationary jaw 28. The backside terminates at first top wall 30. This wall extends inwardly a short predetermined distance to a downwardly extending first abutment surface 31. The abutment surface merges with upper surface 26 which completes the first stationary jaw profile.

As shown, the first abutment surface inclines inwardly from top wall 30 to form an acute angle with upper surface 26. However, other angles including the perpendicular jaws depicted in FIG. 19 can be used as dictated by the corresponding configuration of the workpiece being clamped.

The upper surface 26 comprises a flat planar reference surface. As shown, it extends about half the distance between ends 15,16 to back wall 35 of second stationary jaw 34. The back wall terminates at second top wall 36. The top wall extends horizontally toward second end 16 a short distance to a downwardly extending second abutment surface 37. The abutment surface terminates at a second portion of upper surface 26. This completes the second stationary jaw profile.

From the above, it can be seen that the stationary jaws are an integral part of the vise body. This feature provides a strong immovable backing to the clamping forces directed against them. Also, it is preferred that the size and profile of each stationary jaw be substantially identical.

The upper surface 26 extends without interruption from the second abutment surface to second end 16. The area above this portion is characterized as second clamping region 24. The area above the first portion of upper surface 26 and between the first and second stationary jaws is characterized as first clamping region 22.

It will be noted that the second abutment surface forms an angle with upper surface.26 that is identical with the angle formed between the first abutment surface and upper surface. Thus, they are parallel with each other. Also, both the first and second abutment surfaces are flat and form square intersections with upper surface 26. As such, the upper surface and abutment surfaces function as reference surfaces for engagement with like surfaces of a workpiece clamping extension. This allows two workpieces to be machined in an identical manner with identical reference surfaces.

Note further that the abutment surfaces of both jaws face toward second end 16. This feature provides for the production of machine tools, such as tool bits, that have a reference surface located on the side of the tool which, when clamped in a machine, will be closest to the machine apparatus head. This orientation corresponds to the industry standard for locating reference surfaces.

The upper surface 26 of each clamping region is provided with a corresponding first and second longitudinal slot. The slots create respective first and second slot openings 47,51 which are aligned bilaterally along the median axis of the upper surface.

The first slot opening is defined by opposing flange walls 49. The second slot opening is defined by opposing flange walls 52. Each of the flange walls include a lip portion that extends into a respective channel area 53,54. The lip portions create an undercut behind the opposing flanges for a purpose to be hereinafter described.

Although not essential, the first and second slots may comprise one continuous slot that extends throughout the longitudinal extent of the vise body. This facilitates construction of the vise. It also facilitates accessing the slots from both the first and second ends of the vise body.

Additionally, it is desirable that each of the stationary jaws have a corresponding first and second jaw slot 46,50 extending therethrough. These slots are coextensive with the slot openings 47,51 and have a height sufficient to permit passage of the movable jaws which are hereinafter described.

Each of the clamping regions are provided with a respective first and second movable jaw shown by references 40,40'. The movable jaws include an upper jaw portion 41,41' and a lower runner portion 42,42'. The cross-sectional shape of the lower runner portion corresponds to the cross-sectional shape of the first and second slots. The undercut lip portions of flange walls 49,52 will thereby engage complementary structures of the runner portion so that the jaw will be constrained from vertical movement.

The runner portion of each movable jaw further includes an axially extending shaft opening 44,44'. The interior walls of the opening are threaded for engagement with an actuator means to be hereinafter described.

The upper jaw portion 41,41' is provided with abutment faces 43,43'. The abutment faces are directed toward the corresponding abutment surfaces of each stationary jaw. The abutment faces are preferably disposed to form a solid contact with the clamping extension of a workpiece. However, since they are not used as reference surfaces, this is not essential. The jaw upper portion has a width somewhat less than the slots and a height sufficient to effectively engage a workpiece above the upper surface 26.

The movable jaws are reciprocated with respective actuator means which are attached to the vise body. Hydraulic jack means, pneumatic pistons, mechanical ratchets and other means known in the art could also be used. However, the vise is portable and intended to be hand-held. Thus, it is preferable that the actuator means be light and compact for incorporation into the overall assembly.

As shown, the actuator means includes a first shaft 56. The shaft includes an integral knob 57 at its outer end and threads 69 for engagement with the corresponding threads of runner opening 44. It passes into channel 53 at first end 15 and extends through opening 44 of runner portion 42. It then passes through keeper plate 59.

The keeper plate includes an aperture 67 for supporting the shaft inner end 68. It is positioned transversely to the first slot by insertion through an intersecting passageway 60. The passageway extends through the vise body and is located proximate the second stationary jaw.

The longitudinal extent of the first shaft is sufficient to extend from a point beyond first end 15 to inner end 68 inside the first slot. The portion of the shaft that is outside end 15 includes first knob 57 and first washer 58.

The location of the shaft inner end coincides with the intersection of cross slot 48 and second slot 51. Cross slot 48 extends downwardly through the second slot from upper surface 26. It has a semi-circular cross-section which is coextensive with channels 53,54. As so configured, the shaft terminus is accessible for the attachment of locknut 61.

Figure 8:
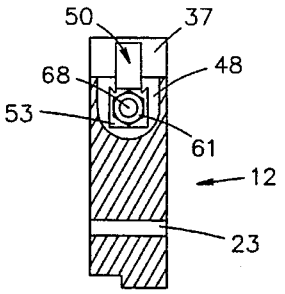
FIG. 8 is a cross-sectional view taken along lines 8—8 of FIG. 2.
Figure 5:
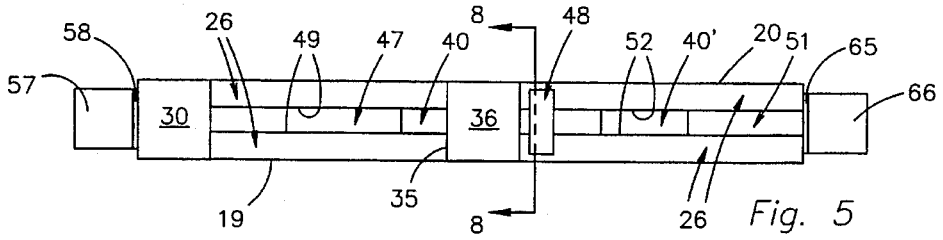
FIG. 5 is a top end view of the vise shown in FIG. 2.

As best shown in FIG. 8, the first channel 53 has sufficient cross-sectional area to clear the diameter of locknut 61. Therefore, the locknut will freely rotate with the shaft. Note that the shaft is constrained from axial dislodgement because the locknut has a diameter greater than aperture 67 of the keeper plate. Also note that axial constraining means other than the locknut could be used. Examples would be end caps, axle hubs, cotter keys and cross pins.

Actuating means for the second movable jaw 40' comprises second shaft 62. This shaft is provided with a retainer head 63 at its inner end. The retainer head is sized to fit within the cross slot 48 and be retained therein by the slot walls abutting against retainer washer 67 and the retainer head underside 73.

The shaft includes second shaft threads 70 which are preferably the reverse of the first shaft threads 69. In this manner, turning the shafts the same direction will result in the same inward or outward axial movement of the movable jaws.

The second shaft extends into runner opening 44' of the second movable jaw. As before, the opening is provided with internal threads corresponding to those of the shaft. The second shaft also has sufficient length to extend from retainer head 63 outwardly a short predetermined distance from second end 16. This provides for its engagement with second knob washer 65 and second knob 66.

Since the shafts are constrained against axial movement, their rotation will result in axial movement of the movable clamps along the slots. For preliminary adjustments, the knobs of both screws are manually grasped and rotated. To achieve a strong clamping force, a tool may be used such as an Allen wrench. For this purpose, the knobs are provided with wrench openings 71 at their outermost end.

With reference now to FIGS. 10–15, a variation of the invention is shown with respect to the use of adaptors in the first and second clamping regions of the vise body. The adaptors greatly enhance the versatility and usefulness of the invention by allowing the clamping regions to accommodate different geometrical shapes and sizes of workpieces. The adaptors are configured to fit within each of the clamping regions while also providing predetermined reference surfaces for engagement with like surfaces of a workpiece. Although not essential to realize the full advantage of the invention, it is preferable that both of the clamping regions be provided with an adaptor and that the adaptor reference surfaces be identical on each adaptor part.

The overall adaptor is shown generally by reference 76. It comprises a solid body having a back surface 77 that extends upwardly from a bottom surface 78. The back surface terminates at an adaptor top wall 79. A front reference surface 80 extends downwardly from the top wall and merges with an outwardly extending leg region 81. The leg region includes a top reference surface 82.

The adaptor bottom surface is flat for resting upon the vise body upper surface 26. The leg region top surface is also flat and extends parallel to the bottom surface. In this way, when the adaptor is positioned upon the upper surface of a clamping region, the top surface will be parallel to the upper surface. The front surface is flat and extends at an angle relative to the top surface which will be predetermined by the configuration of the workpiece being clamped. Since it is the workpiece clamping extension reference surfaces that will be engaged by the adaptor front surface, both the front surface and leg portion top surface must precisely accommodate the corresponding workpiece reference surfaces.

For purposes of this invention, the term workpiece clamping extension comprises the lower portion of a workpiece that is not machined. It is used solely for providing a defined structure for engagement with the clamping mechanism of a machining apparatus. The defined structure always includes a specified reference surface for engagement with the corresponding reference surface of a clamping means.

To ensure that the adaptor is properly aligned within the clamping region, the back surface 77 should be flat and form an angle with the adaptor bottom surface that corresponds with the angle between the vise body upper surface 26 and the abutment surface of a respective stationary jaw. Thus, when the adaptor is in place within the vise clamping region, the adaptor top surface will function in the same manner as the clamping region upper surface and the adaptor front surface will function in the same manner as the stationary jaw abutment surface.

Leg region 81 of the adaptor includes an elongated leg slot 83. It is aligned to be coextensive with the underlying first or second slots to permit axial movement of the movable jaws.

To help prevent dislodgment of the adaptor from its position in a clamping region, the back surface 77 is provided with an outwardly extending projection 85. Preferably the projection has a height and width less than the corresponding dimensions of the back surface and extends outwardly a predetermined distance that is less than the depth of a stationary jaw.

The abutment surface of each stationary jaw is provided with a centrally located notch 86,86'. The notches extend into the surfaces a predetermined amount as dictated by the outward extent of the projection. They form an enlarged front area of the jaw slots 46,50 and correspond to the configuration of the projection. In this manner, when the projection is inserted into the notch, a close engagement will result whereby lateral movement of the adaptor will not occur.

Figure 15:
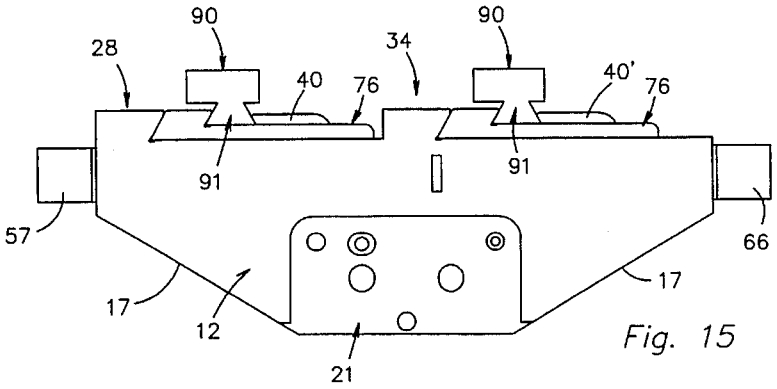
FIG. 15 shows a front plan view of the vise of FIG. 10 showing a workpiece engaged within adaptors of both clamping regions.
Figure 16:
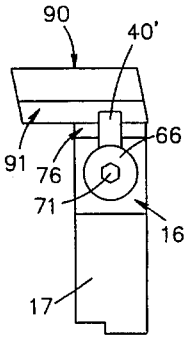
FIG. 16 is a right end elevation view of the assembly shown in FIG. 15.

FIGS. 15 and 16 illustrate use of the above-described adaptors on small workpieces 90 with dovetail-shaped clamping extensions 91.

Figure 17:
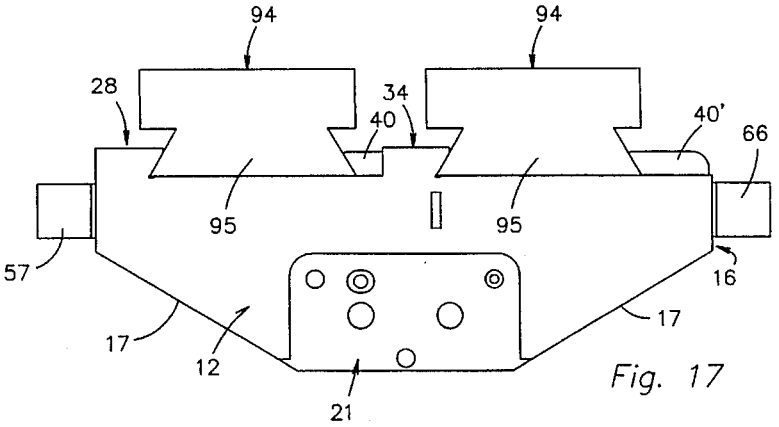
FIG. 17 is a front plan view of the vise shown in FIG. 2 illustrating the dual clamping engagement of a different type of workpiece without the use of adaptors.
Figure 18:
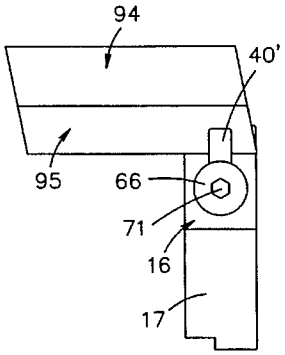
FIG. 18 is a right end elevation view of the assembly shown in FIG. 17.

FIGS. 17 and 18 depict the engagement of large workpieces 94 directly within the first and second clamping regions. The workpiece clamping extensions 95 are also large to facilitate a strong engagement.

Figure 19:
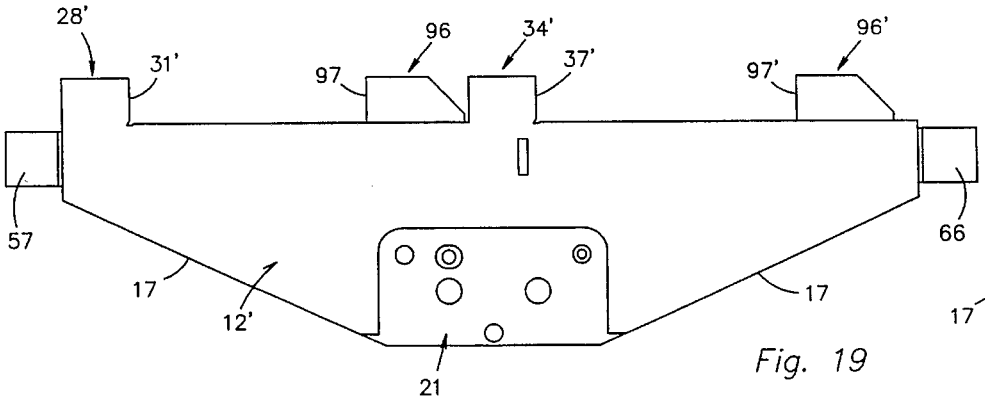
FIG. 19 is a front plan view of the vise shown in FIG. 2 with an alternative jaw configuration.
Figure 20:
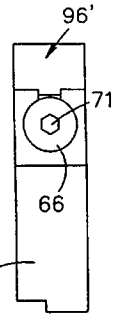
FIG. 20 is a right end elevation view of the vise shown in FIG. 19.

FIGS. 19 and 20 show the vise of FIG. 2 which has been modified to include perpendicular abutment areas. Note vise body 12' having first and second stationary jaws 28',34'. The abutment surfaces 31',37' have been modified to be perpendicular to upper surface 26. Movable jaws 96,96' have also been changed to include abutment faces 97, 97' that are perpendicular to upper surface 26.

The above variations are intended to illustrate how the jaws can be adapted to conform to rectangular-shaped clamping extensions of various types of workpieces. It will be appreciated that a similar configuration could be used on the front surface of adaptor 76 and/or the corresponding surfaces of the adaptor back side 77.

From the above, it can be seen that the overall apparatus provides a precision workpiece clamping assembly that is adaptable to a variety of workpiece configurations while still maintaining the integrity of precision alignments. By referencing two workpieces at one time, the invention provides for a significant savings in set-up time. It provides for more reliable and accurate machining work. And, it facilitates automated machining of complex parts.

While the above invention has been described with respect to preferred embodiments, it will be apparent to those skilled in the art that additional modifications and improvements could be made without departing from the scope and spirit of the invention. Therefore, it is to be understood that the invention is not to be limited by the specific illustrative embodiments but only by the scope of the appended claims.

I claim:

1. A dual vise assembly comprising:

a vise body having a clamping portion and a connector portion;

said clamping portion having an upper surface extending longitudinally between a first end and a second end;

a first stationary jaw extending upwardly from said upper surface at said first end and a second stationary jaw extending upwardly from said upper surface at a location between said first stationary jaw and said second end;

said first stationary jaw comprising a first body defined by an outside wall, a first top wall and a first abutment surface which faces toward said second stationary jaw;

said second stationary jaw defined by a back wall, a second top wall and a second abutment surface which faces said second end;

a first movable jaw positioned between said first and second stationary jaws having a first movable abutment face directed toward said first stationary jaw;

a first actuator means attached to said vise body for moving said first movable jaw relative to said first stationary jaw;

a second movable jaw positioned between said second stationary jaw and said second end having a second movable abutment face directed toward said second stationary jaw; and, a second actuator means attached to said vise body for moving said second movable jaw relative to said first stationary jaw.

2. The assembly of claim I wherein said first and second abutment surfaces are flat and parallel to each other.

3. The assembly of claim 2 wherein said upper surface is flat and said first and second abutment surfaces extend at a predetermined angle relative to said upper surface.

4. The assembly of claim 3 including a first slot extending into said upper surface at least between said first and second stationary jaws and a second slot extending into said upper surface at least between said second stationary jaw and said second end.

5. The assembly of claim 4 wherein said first and second movable jaws each include an upper jaw portion extending above said upper surface and a lower runner portion extending into a corresponding first or second slot.

6. The assembly of claim 1 including an adaptor removably connected to at least one of said stationary jaws, said adaptor having a body defined by a back surface extending upwardly from a bottom surface to an adaptor top wall having a front surface extending downwardly to an outwardly extending leg region, said bottom surface being flat for resting upon said vise body upper surface and said leg region having a top surface which is flat and parallel to said bottom surface.

7. The assembly of claim 6 wherein said front surface is flat and extends at a predetermined angle relative to said top surface.

8. The assembly of claim 7 wherein said back surface is flat and forms an angle with said bottom surface that corresponds with the angle between said vise body upper surface and the abutment surface of said first and second stationary jaws.

9. The assembly of claim 8 wherein the abutment surface of said first and second stationary jaws includes a notch and the back surface of said adaptor includes an outwardly extending projection for engaging said notch.

10. A vise assembly having two independent clamping systems comprising:

a vise body defined by a bottom end and an upper end which are joined by a first end and an opposing second end;

said upper end having a predetermined longitudinal extent which is recessed to form a first clamping region and a second clamping region with each one of the regions having a bottom area defined by an upper surface;

said first region defined by the area above its respective upper surface and the area between a first stationary jaw at the vise body first end and a second stationary jaw located proximate the mid-portion of said upper end;

said second region defined by the area above its respective upper surface and the area between the second stationary jaw and said vise body second end;

each of said stationary jaws having abutment faces which are parallel to each other and face the vise body second end at like angles relative to said upper surface; and, each of said regions including a movable jaw that coacts with a respective first and second stationary jaw to releasably secure a workpiece.

11. The assembly of claim 10 wherein each of said first and second clamping regions includes an actuation means for moving a respective movable jaw relative to a corresponding stationary jaw.

12. The assembly of claim 11 wherein said upper surface of both first and second clamping regions are provided with a longitudinally extending slot and each movable jaw includes a runner portion that extends into a corresponding slot.

13. The assembly of claim 12 wherein each runner portion includes a threaded opening and each actuation means comprises a shaft mounted for rotation within a respective slot having threads corresponding to said threaded opening, said shaft extending through said opening whereby rotation of the shaft will result in axial movement of said movable jaw.

14. The assembly of claim 13 including a cross-slot extending across said longitudinally extending slot at a location adjacent said second stationary jaw with each shaft having an inner end that terminates at said cross-slot.

15. The assembly of claim 14 wherein each shaft includes an outer end projecting beyond a respective first and second end of said vise body;

a cap means secured to each end for manual rotation of the shaft; and, retention means positioned within said cross-slot for constraining axial movement of each shaft.

16. The assembly of claim 10 including an adaptor removably attached to said stationary jaws, said adaptor having a body with a back surface engagable with a respective stationary jaw abutment surface and a bottom surface that engages a respective upper surface of said first and second clamping regions, said body including a front surface that merges into an outwardly extending leg region having a top surface that is parallel to said bottom surface, said front surface and top surface forming a predetermined angle with each other.

17. The assembly of claim 16 wherein the abutment surface of said first and second stationary jaws includes a notch and the back surface of said adaptor includes an outwardly extending projection for engaging said notch.

18. The assembly of claim 10 wherein said vise body bottom end is flat and parallel with said upper surface; said vise body including a connector portion adjacent said bottom end for adjustable attachment to a workpiece alignment part.

* * * * *